US007679630B2

(12) United States Patent
Sagi et al.

(10) Patent No.: US 7,679,630 B2
(45) Date of Patent: Mar. 16, 2010

(54) HORIZONTAL COLOR PLANE REGISTRATION CORRECTION

(75) Inventors: Dani Sagi, Nos Ziona (IL); Craig Breen, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 758 days.

(21) Appl. No.: 11/529,160

(22) Filed: Sep. 28, 2006

(65) Prior Publication Data

US 2008/0079797 A1 Apr. 3, 2008

(51) Int. Cl.
*B41J 2/435* (2006.01)

(52) U.S. Cl. ..... 347/116

(58) Field of Classification Search ..... 347/116, 347/234, 235, 247, 248; 399/301
See application file for complete search history.

(56) References Cited

U.S. PATENT DOCUMENTS 6,563,524 B1 * 5/2003 Regimbal et al. ..... 347/116

* cited by examiner

*Primary Examiner*—Huan H Tran

(57) ABSTRACT

A method for detecting and correcting misregistration between a plurality of separations printed by a printing apparatus, comprising: producing a calibration print output on a substrate, the calibration print output including at least one calibration pattern, wherein the at least one calibration pattern translates horizontal misregistration into a detectable indicator of misregistration in a process direction; detecting misregistration; and, performing a fine adjustment of the horizontal position of at least one of the separations using the at least one calibration pattern.

25 Claims, 5 Drawing Sheets

HORIZONTAL COLOR PLANE REGISTRATION CORRECTION

FIELD OF THE INVENTION

The present invention relates in general to printing and particularly to detecting and/or correcting misregistration in printing.

BACKGROUND OF THE INVENTION

When multicolor information is to be imaged or written, a final compound color is obtained, in general, by superimposing print separations. Each print separation has a different basic color, and the color separation prints are coordinated with and aligned relative to each other. In general, a plurality of dots or patches, each of different basic colors, are printed in a same locality so as to be aligned with or superimposed on each other. Such superposition of print separations gives the impression of a full color image having colors that may be different from the basic colors.

Normally three or four separations are used, each with a basic (process) color, (or optionally, black) in order to obtain a final compound color. In some cases additional color separations are also used. The final compound image is obtained by finely adjusting, through alignment of the system, the position of each separation, to accurately overlay the separation prints. The alignment process and the alignment itself are called registration.

When the separations are printed slightly out of registration, the appearance of an image is slightly impaired. However, if the separations are more than slightly out of registration, the effect will be disturbing to an observer. In particular, the individual edges of objects formed by each one of the separations will separate and the quality of the final multicolor image will be greatly impaired.

WO 00/43206 to Indigo, N. V., the disclosure of which is herein incorporated by reference, describes an apparatus and method for correcting print separation registration in a printing apparatus or photocopier.

SUMMARY OF THE INVENTION

An aspect of some exemplary embodiments of the invention relates to providing a method for detection and correction of horizontal misregistration between a plurality of print separations, which translates horizontal misregistration into an indication of misregistration in a vertical, process direction. Optionally, the method is capable of detection and correction of horizontal misregistration using one calibration pattern. In an embodiment of the invention, the method is used for correcting horizontal misregistration in electrostatic printing apparatus.

In an exemplary embodiment of the invention, a calibration print output is produced by a print engine for registration/misregistration analysis. The calibration print output is used to detect and correct any misregistration of the plurality of separations and/or to detect if the plurality of separations is registered. Optionally, a plurality of separations is considered registered if misregistration is within a prescribed acceptable limit.

The calibration print output is finely adjusted by analyzing the at least one calibration pattern with respect to an associated offset marker on the output, in accordance with an exemplary embodiment of the invention. As indicated above, the at least one calibration pattern is configured such that horizontal misregistration is translated into a process direction (i.e. vertically) detectable indicator. In an embodiment of the invention, analysis of the at least one calibration pattern is performed by a controller.

In an embodiment of the invention, the plurality of print separations comprise lines that form an interference pattern forming, for example, a Moiré pattern. In this embodiment, the Moiré pattern comprises a one or more dark and/or light bands whose position in the process direction reflects the quality of horizontal (cross-scan) registration. Optionally, the indicator is a light band. The associated offset marker, against which the detectable indicator is measured, is also adapted to be detectable by at least one sensor for translation of any horizontal misregistration in the process direction. An analysis of the calibration pattern against the offset markers, manually and/or automatically, and inputting the data derived from the analysis into the controller indicates to the controller what adjustments need to be made in the operation of the printing apparatus in order to provide printing apparatus operation within the prescribed acceptable limits. Optionally, the calibration pattern is comprised of more than one color. Optionally, the calibration pattern is comprised of a plurality of separations. Optionally, a rough adjustment is performed prior to the fine adjustment. Optionally, the dark band of the Moiré pattern is used to determine the horizontal alignment.

Optionally, the horizontal alignment is adjusted by adjusting the timing of the writing of the horizontal lines for one or both separations. In some embodiments of the invention, the horizontal offset and/or scaling of at least one separation is adjusted to implement at least a partial correction of misregistration. In an embodiment of the invention, the frequency of the pixel clock may be adjusted. Optionally, the pixel clock is adjusted dynamically, for example in response to commands received from the controller.

In an embodiment of the invention, the process of producing a calibration print output, rough adjusting the output and/or fine adjusting the output is repeated using at least one incremental step in order to bring printing apparatus operation within the prescribed acceptable limits, as necessary.

An aspect of some exemplary embodiments of the invention relates to providing a printing apparatus including a controller programmed to conduct a method for detection and correction of horizontal misregistration between various print separations using one calibration pattern. In some embodiments of the invention, the same calibration pattern is printed in a plurality of locations on a calibration print output for misregistration analysis. Optionally, the controller automatically performs the method. In some exemplary embodiments of the invention, the printing apparatus is provided with at least one sensor in operative communication with the controller for measuring at least one indicator of horizontal misregistration (and/or registration if it is determined there is no misregistration within prescribed acceptable limits). Optionally, an indicator is at least two rough adjustment lines. Optionally, an indicator is a calibration pattern and corresponding offset markers. In some exemplary embodiments of the invention, the controller is operatively connected to a user input device for receiving manually detected data regarding horizontal misregistration. Based on the data received from the at least one sensor and/or the user, controller adjusts operation of the printing apparatus to provide an output closer to, or within, the prescribed acceptable limits. Optionally, the controller repeats its program, each repetition comprising at least one incremental step towards bringing printing apparatus operation within the prescribed acceptable limits (e.g. in scenarios where the printing apparatus is operating outside of those limits). If the vertical indication is linear with respect to the horizontal misregistration, then it may not be necessary to repeat the correction.

There is thus provided in accordance with an embodiment of the invention, a method for detecting and correcting misregistration between a plurality of separations printed by a printing apparatus, comprising: producing a calibration print output on a substrate, the calibration print output including at least one calibration pattern, wherein the at least one calibration pattern translates horizontal misregistration into a detectable indicator of misregistration in a process direction; detecting misregistration; and, performing a fine adjustment of the horizontal position of at least one of the separations using the at least one calibration pattern. In some embodiments of the invention, a plurality of offset markers are associated with the at least one calibration pattern. In some embodiments of the invention, the fine adjustment is performed using the at least one calibration pattern and the associated offset markers. In an embodiment of the invention, the method further comprises producing the calibration print output with a plurality of rough adjustment lines in addition to the at least one calibration pattern. Optionally, the method further comprises correcting misregistration by performing a rough adjustment using the plurality of rough adjustment lines prior to performing the fine adjustment.

There is further provided in accordance with an embodiment of the invention, a method for detecting misregistration between a plurality of separations printed by a printing apparatus, comprising: (a1) producing a calibration print output on a substrate, the calibration print output including at least one calibration pattern with a plurality of corresponding offset markers, wherein the at least one calibration pattern translates horizontal misregistration into a detectable indicator of misregistration in a process direction. In an embodiment of the invention, the method further comprises: (a2) producing the calibration print output with a plurality of rough adjustment lines in addition to the at least one calibration pattern. In an embodiment of the invention, the method further comprises: correcting misregistration by performing at least one of the following: (b) a rough adjustment using the plurality of rough adjustment lines; and, (c) a fine adjustment using the at least one calibration pattern and the corresponding offset markers. In an embodiment of the invention, the method further comprises: correcting misregistration by performing: (b) a fine adjustment of the horizontal position of at least one of the separations using the at least one calibration pattern and the corresponding offset markers. Optionally, the calibration pattern is produced from a plurality of sub-patterns. Optionally, each of the plurality of sub-patterns is associated with one of the plurality of separations. Optionally, at least one of the plurality of sub-patterns is produced in a different color than the rest of the plurality of sub-patterns. Optionally, at least one of the plurality of sub-patterns is produced in the same color as another of the plurality of sub-patterns. In some embodiments of the invention, performing a fine adjustment includes controlling operation of at least one laser of the printing apparatus to cause a light band in the calibration pattern to be centered in relation to the corresponding offset markers. Optionally, the calibration print output is produced with a calibration pattern on the back of the substrate. Optionally, each of the plurality of rough adjustment lines is associated with one of the plurality of separations. Optionally, at least one of the plurality of rough adjustment lines is produced in a different color than the rest of the plurality of rough adjustment lines. In some embodiments of the invention, performing a rough adjustment includes controlling operation of the printing apparatus to cause the plurality of rough adjustment lines to at least touch.

There is further provided in accordance with an embodiment of the invention, a printing apparatus for detection and correction of horizontal misregistration between a plurality of print separations, comprising: a latent image forming device adapted for forming a plurality of latent images of the plurality of print separations, developing the latent image, and printing the latent image on a substrate; a controller in communication with at least the latent image forming device adapted to control the latent image forming device in the forming of a calibration pattern, which translates horizontal misregistration into a detectable indicator of misregistration in a process direction, sufficient for detection and correction of horizontal misregistration between the plurality of print separations on a calibration print output; and, wherein upon receipt by controller of an indication of horizontal misregistration, controller controls the latent image forming device to form the plurality of latent images in at least an incremental step towards correcting the horizontal misregistration. In an embodiment of the invention, the apparatus further comprises a user input device including a display which prompts a user to input detected horizontal misregistration in communication with the controller. In an embodiment of the invention, the apparatus further comprises at least one sensor adapted to sense at least one indicator of horizontal misregistration on the calibration print output and communicate the sensed misregistration to the controller. Optionally, at least one indicator of horizontal misregistration is a calibration pattern comprised of at least two sub-patterns which when overlapped form a light band within the calibration pattern. Optionally, the calibration pattern includes a plurality of corresponding offset markers. Optionally, the sensor is positioned to sense the calibration pattern printed on the back of the substrate. Optionally, the sensor is positioned to view more than one calibration pattern is printed on the calibration print output. In some embodiments of the invention, at least one of the plurality of separations is printed in a different color than the rest of the separations. In some embodiments of the invention, at least one of the plurality of separations is printed in the same color as another of the separations.

BRIEF DESCRIPTION OF FIGURES

Exemplary non-limiting embodiments of the invention are described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. In the attached figures.

DETAILED DESCRIPTION OF EXEMPLARY EMBODIMENTS

Figure 1:
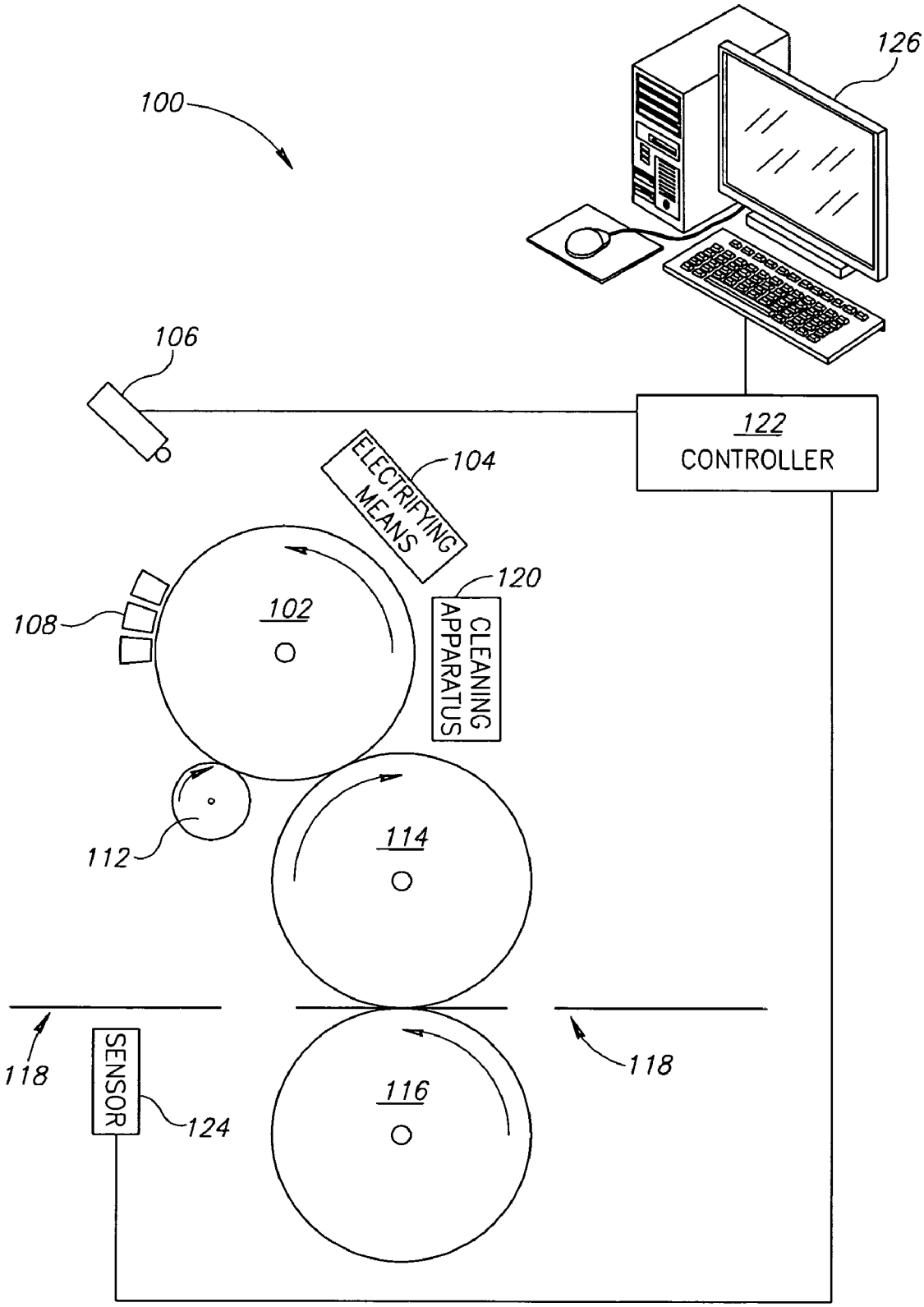
FIG. 1 is a schematic of a printing apparatus suitable for detection and correction of misregistration between various separations, in accordance with an exemplary embodiment of the invention.

FIG. 1 shows a portion of an electrostatic printing apparatus 100 suitable for detection and/or correction of separation misregistration, in accordance with a preferred embodiment of the invention. The methodology of the image formation using printing apparatus 100 can accomplished using any of a wide variety of different available powder or liquid toner systems, for example the HP Indigo® Press 5000, available from Hewlett-Packard. In general, the present invention does not appear to be tied to any particular system of printing apparatus, although the cause and severity of misregistration problems may depend on the imaging method and particular/or imaging system used. In the following discussion, the printing apparatus is described in rather general terms to emphasize the general application of the invention.

In an exemplary embodiment of the invention, a photoreceptor 102 is electrified by a corotron, scorotron or other electrifying means 104. A scanning laser 106 beam or beams impinge on photoreceptor 102 and form a latent image of a particular separation thereon. A dispenser of liquid toner 108 which may be, for example, a binary ink developer ("BID") cartridge, as described in one or more of U.S. Pat. No. 5,596,396 to Landa et al., and U.S. Pat. No. 5,610,694, to Lior et al., the disclosures of which are incorporated by reference. Optionally, a plurality of BID cartridges is used, each containing a different color toner. Alternatively, the dispenser of liquid toner is any one of the following: a spray dispenser, a series of spray dispensers or a series of slit dispensers, as known in the art, supply a liquid toner of a color corresponding to the separation. Optionally, the toner is a powder toner, applied in any manner known in the art.

The latent image is developed by the toner to form a visible image on photoreceptor 102. In some embodiments of the invention, a squeegee roller 112 compresses the image and removes excess liquid therefrom, prior to the transfer of the image to an intermediate transfer member ("ITM") 114. The image is then transferred to a substrate 118 at a nip between ITM 114 and an impression roller 116. After transfer of the image to ITM 114, residual toner and charge on photoreceptor 102 are optionally removed by discharge and cleaning apparatus 120 which may be any of the many types that are well known in the art.

Individual separations are written (by scanning laser 106), developed and transferred to substrate 118 in seriatim. Optionally, a plurality of separations (or all the separations) may be transferred to the ITM first and then transferred as a group to the final substrate.

Unfortunately, the horizontal registration of the separations may not be perfect. Thus, in a calibration operational mode for printing apparatus 100, the image created is a calibration print output (described in more detail with respect to FIGS. 2-4), which is optionally used for detection and/or correction of horizontal separation misregistration, in accordance with an exemplary embodiment of the invention. In an exemplary embodiment of the invention, calibration for correcting horizontal misregistration is conducted by printing apparatus 100 using at least a controller 122.

Controller 122 is programmed with software to, inter alia, control the laser to write the latent image for the separations. In addition, controller 122 receives data pertaining to separation misregistration and makes corrections in the operation of printing apparatus 100 to correct the misregistration. For example, by directing scanning laser 106 to alter its latent image formation on photoreceptor 102 such that misregistration will not take place, or will be reduced to within a prescribed acceptable limit. In some embodiments of the invention, the horizontal offset and/or scaling of at least one separation is adjusted to implement at least a partial correction of misregistration. Optionally, the horizontal misregistration is corrected by adjusting the timing of the writing of the horizontal lines by scanning laser 106, for at least one separation. Optionally, the timing is adjusted dynamically, for example in response to commands received from controller 122. In an embodiment where data pertaining to separation misregistration is provided to controller 122 manually, for example by a user of printing apparatus 100, the calibration print output is produced by printing apparatus 100 and is examined by the user for perceived misregistration problems.

Printing apparatus 100 is optionally provided with a user input device 126, for example including a keyboard, with which to enter user-detected horizontal misregistration data. Examples of what and/or how the user enters data are described below with respect to FIGS. 2-4. Optionally, user input device 126 is provided with a display for displaying information pertaining to printing apparatus 100 to user. In an exemplary embodiment of the invention, user input device 126 is in operative communication with controller 122. In some embodiments of the invention, the user of printing apparatus 100 is prompted by software to enter misregistration data. Optionally, controller 122 is programmed with the software which is used to prompt the user to enter misregistration data. Optionally, the software which is used to prompt the user is the same software used to control the laser, as described above. It should be understood that user input device 126 is optionally provided to printing apparatus 100 without regard to whether data pertaining to separation misregistration is provided manually, for example to allow the user to operate printing apparatus 100.

In some embodiments of the invention, data pertaining to separation misregistration is provided to controller 122 automatically. In some exemplary embodiments of the invention, the print engine is provided with at least one sensor 124, in operative communication with controller 122, for measuring at least one indicator of horizontal misregistration (and/or registration if it is determined there is only slight misregistration within prescribed acceptable limits). Optionally, an indicator is at least two rough adjustment lines (described below). Optionally, an indicator is a calibration pattern and a plurality of offset markers (described below). Optionally, the at least one sensor 124 is a densitometer provided with an appropriate resolution for carrying out the final adjustment described herein.

It should be noted that the printing apparatus configuration shown is only used to illustrate an exemplary configuration for carrying out the present invention and that other configurations could be used to achieve substantially the same effect (e.g. optionally, ITM 114 is not used).

Figure 2:
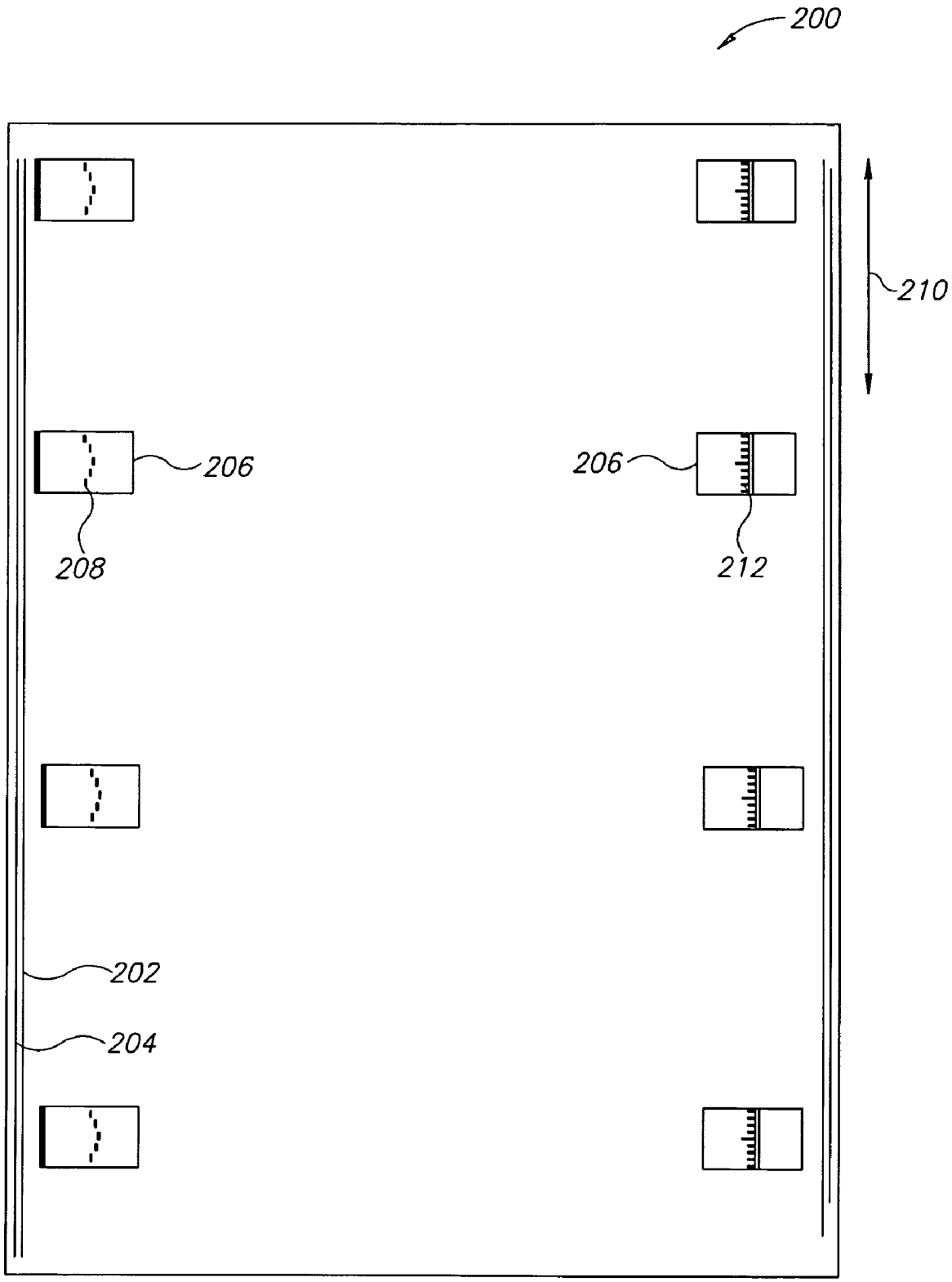
FIG. 2 is a calibration print output, in accordance with an exemplary embodiment of the invention.

Referring to FIG. 2, a calibration print output 200 is shown in accordance with an exemplary embodiment of the invention. In an embodiment of the invention, calibration print output 200 is used to translate horizontal misregistration into at least one detectable indicator in the process, or vertical, direction 210. Calibration print output 200 is comprised of a plurality of separations printed onto a substrate, in some embodiments of the invention.

Calibration print output 200 is provided with at least one calibration pattern 206 optionally with a plurality of offset markers 208, shown in the calibration patterns located on the left side of calibration print output 200 in FIG. 2. Calibration pattern 206 and offset markers 208 are described below. In an exemplary embodiment of the invention, calibration pattern 206 and the corresponding offset markers 208 are used for making fine adjustments in horizontal registration, for example as described with respect to FIG. 4. In an exemplary embodiment of the invention, a plurality of calibration patterns 206 and corresponding offset markers 208 are printed in various locations on calibration print output 200 to correct for misregistration in a plurality of places on substrate 118.

Optionally, a visually perceptible scale 212, shown in the right side calibration patterns of FIG. 2, is printed in calibration pattern 206 for performing manual fine adjustments of misregistration.

In some exemplary embodiments of the invention, at least two rough adjustment lines 202, 204 are printed as a pair on calibration print output 200, with each rough adjustment line corresponding to a separation. Optionally, rough adjustment lines are printed in more than one location on calibration print output 200, for example on the left and right sides, such as shown in FIG. 2. Optionally, each rough adjustment line of each pair is printed in a different color, assisting with the identification of the individual separations and/or misregistration errors. In an exemplary embodiment of the invention, rough adjustment lines 202, 204 are used for making rough adjustments in horizontal registration, for example as described below and with respect to FIG. 4.

Figure 3A:
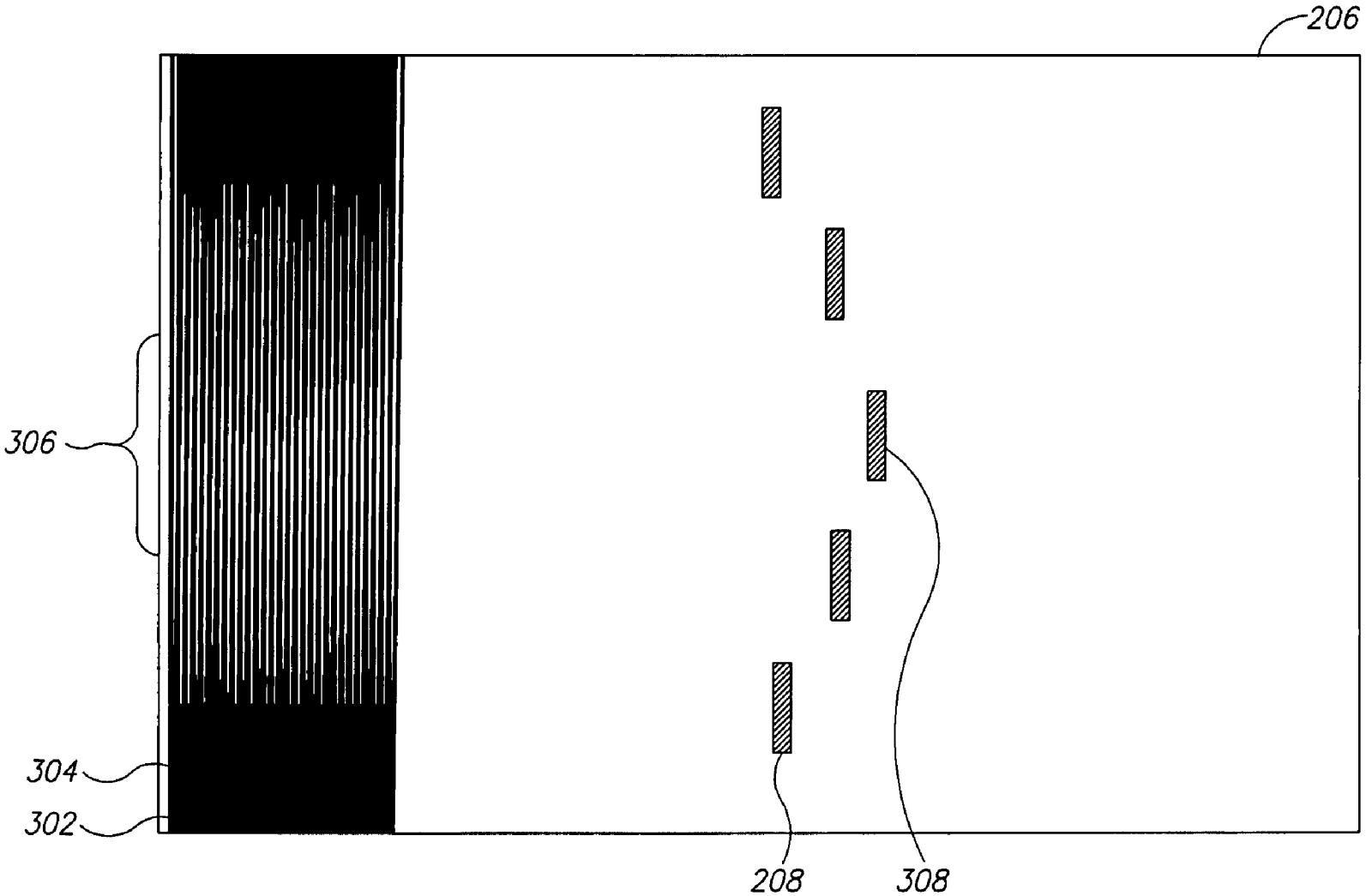
FIG. 3A depicts a detailed view of a calibration pattern and offset markers in a registered condition, in accordance with an exemplary embodiment of the invention.

FIG. 3A, shows a detailed view of a calibration pattern 206 and offset markers 208 in a registered condition, in accordance with an exemplary embodiment of the invention. In some embodiments of the invention, calibration pattern 206 is comprised of at least two overlapping sub-patterns. Each sub-pattern is optionally associated with one of a plurality of separations used to produce calibration pattern 206. In some exemplary embodiments of the invention, both separations are printed in black, for maximum contrast. Since misregistration is generally not a function of the color, black is used since it gives a high contrast. Optionally, each separation is printed in a different color. For example, the first separation is optionally printed in magenta, whereas a different separation is optionally printed in black. Other typical colors for print separations include cyan and/or yellow, although colors and/or more than two separations are not required for the instant misregistration correction method. It should be understood that only a small portion of calibration pattern 206 is shown, but in an exemplary embodiment of the invention, calibration pattern 206 substantially occupies the box shown in FIGS. 2-3A-B.

In an embodiment of the invention, each sub-pattern comprises an array of lines, generally running in the process direction and closely spaced in the horizontal direction. The lines in each sub-pattern form an angle with the process direction which is different from the angle for the other sub-pattern. Thus, the lines in the subsets cross at a fixed spacing in the process direction, given by $s/(\sin \alpha)$, where s is the spacing between the lines and $\alpha$ is the angle at which the lines in the two sub-patterns cross. For small $\alpha$, this reduces to $s/\alpha$ ($\alpha$ in radians)

Using this formula, a line spacing of 1 mm and an angle of 4 degrees ($=4\pi/180$ radians), the distance between crossings is about 14 mm. More importantly, when one of the sub-patterns is moved 100 micrometers (0.1 mm) horizontally with respect to the other, the crossings move about 1.4 mm in the process direction. This vertical offset is linear with the horizontal offset and measurements of the relatively large vertical offset allows for measurement, with substantial accuracy, of very small horizontal offsets.

It is understood that halfway between the crossings, each set of lines will be exactly between the lines. Thus, at the crossings a maximum unprinted area is produced and between the crossings a minimum unprinted area is produced. If the lines are half the spacing, then the contrast is a maximum. This results in alternating light and dark bands in the printed result.

These values of angle and spacing and line width are just an example and other values can be used if different sensitivity or contrast is desired.

In an exemplary embodiment of the invention, a first sub-pattern 302 is printed during the first separation using a given color. Optionally, the color is black or magenta. A second sub-pattern 304 is printed as a subsequent separation, in accordance with an embodiment of the invention. Optionally, the subsequent separation is the final separation of the image being printed. Optionally, second sub-pattern 304 is printed in a black color. Optionally, the lines in each sub-pattern are between 0.25 and 0.75 microns apart. Optionally, the lines in each sub-pattern are approximately 0.5 microns apart. In some embodiments of the invention, for example in manual embodiments, line spacing is selected for ease of perceptibility to the human eye. In some embodiments of the invention, line spacing is selected which results in a vertical offset that is readable by automatic sensors.

In an exemplary embodiment of the invention, when calibration pattern 206 comprised of the at least two overlapping sub-patterns 302, 304 is observed and magenta and black are used as the print colors, a light band 306 appears where the lines of the two sub-patterns 302, 304 touch or overlap. Where they do not touch or overlap, the calibration pattern assumes a color similar to that of the magenta separation. It is noted that if black and magenta are used then the pattern will have a reddish tint when the lines do not cross, which will disappear when they cross and the magenta is obscured by the black. Alternatively cyan or yellow could be used.

Figure 3B:
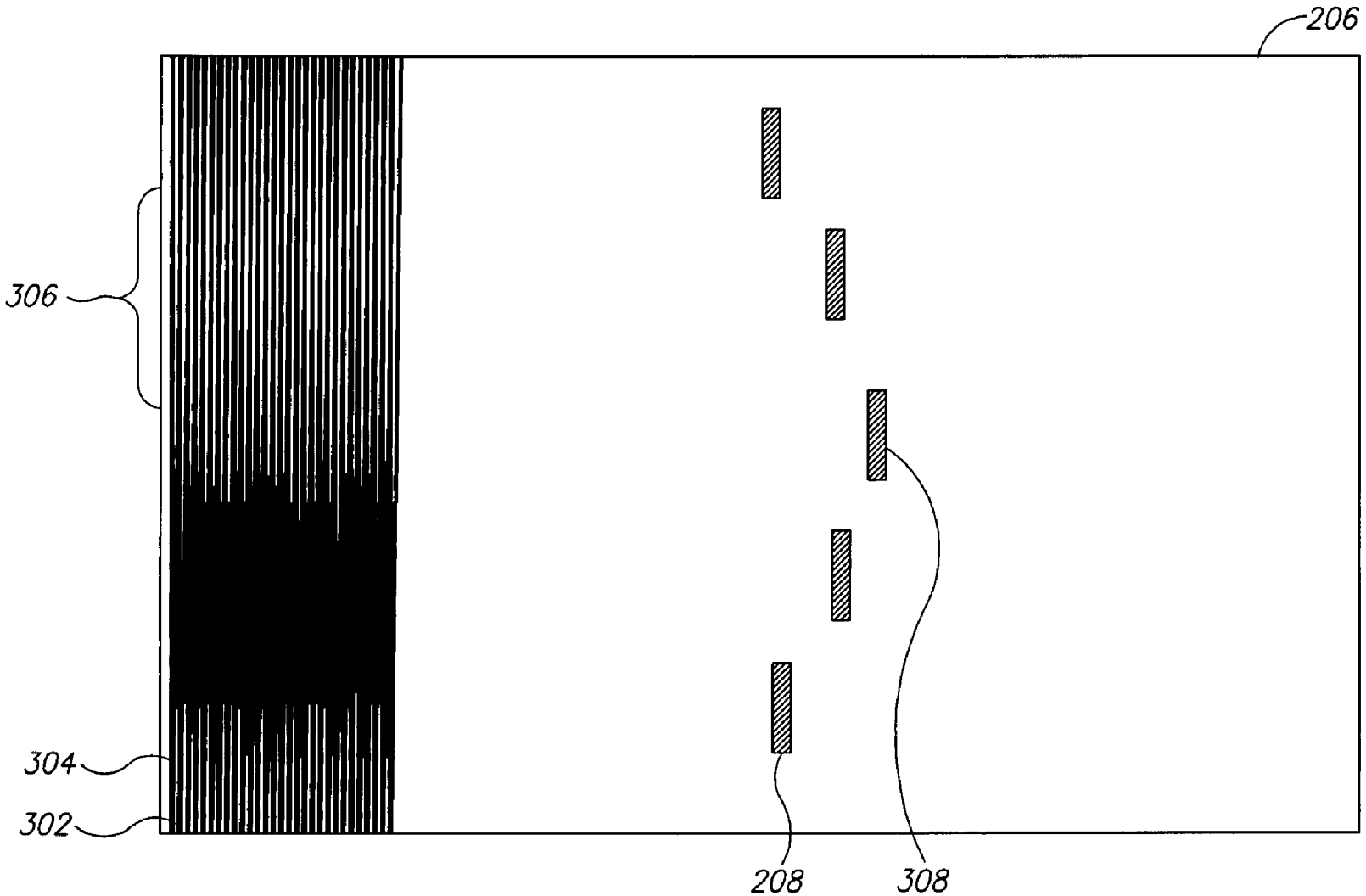
FIG. 3B depicts a detailed view of a calibration pattern and offset markers in a misregistered condition; and, FIG. 4 is a flow chart depicting a method of measuring and correcting misregistration between various separations, in accordance with an exemplary embodiment of the invention.

Offset markers 208 are provided to calibration pattern 206 which are detectable by a sensor, for example a densitometer. In an embodiment of the invention, offset markers 208 are arranged on calibration pattern 206 in a manner that will convey to controller 122 the approximate position of light band 306 on the calibration pattern 206. It should be understood that the sub-patterns 302, 304 are overlapped in a manner such that if first sub-pattern 302, and thus the first separation, is registered with second sub-pattern, and thus the subsequent separation, then light band 306 is centered at the "0" (offset marker 308) on the offset markers 208. In an exemplary embodiment of the invention, corresponding offset markers 208 are related to calibration pattern (for example by printing it together with one of the separations) so that slight horizontal misregistration, approx. 0.5 mm in some embodiments, of the sub-patterns 302, 304 causes light band 306 to move up or down in relation to offset markers 208 (for example as shown in FIG. 3B), in process direction 210, by 30 mm. This movement by light band 306 in relation to offset markers 208 is the process (vertical) direction manifestation of horizontal misregistration, in accordance with some embodiments of the invention. It should be noted that the location of offset markers above and below the "0" marker are stored in controller 122, such that when light band 306 is detected near a particular offset marker, the approximate distance and direction of misregistration is indicated, in accordance with an exemplary embodiment of the invention.

In some embodiments of the invention, the separations are configured that the white (or colorless) band is at the center of the pattern (as shown in FIG. 3A). Alternatively, the patterns are configured so that the dark (or reddish) band is at the center.

In addition to horizontal misregistration correction, vertical misregistration can be corrected utilizing the patterns and method shown in WO 00/43206 and WO 2004/088969, the disclosures of which are incorporated herein by reference. Alternatively, other methods, as known in the art, may be used to correct vertical misregistration. In principle, vertical misregistration should be corrected first to avoid its effect on the measurement of horizontal registration. However, since the effect of horizontal misregistration on the band position is many times greater than that of the vertical misregistration, in practice, the order may not be important.

Since the horizontal alignment mechanism described above is very sensitive, it may be necessary to perform a coarse horizontal alignment before utilizing the above described method. Any of the many methods of providing this coarse alignment can be used, for example, if two parallel arrays of lines running in the process direction are provided (for example lines 202 and 204, then the density and possibly the color of the image will be a function of the spacing between the lines. The lines to be printed are designed so that they print one top of each other when alignment is correct. When two different colors are used for the separation (such as for example black and magenta) horizontal misregistration will manifest itself in impartation of a reddish hue to the area of the lines. The direction and approximate amount of misregistration can be determined from a magnified view of the print.

Another method of performing rough adjustment is to use the same methodology as described with respect to FIG. 3 and adjusting the spacing and angles so that the sensitivity is convenient for measuring larger misregistration.

Alternatively, in some embodiments of the invention, a simple visual observation of a printed image may be sufficient to bring the image into rough registration.

Figure 4:
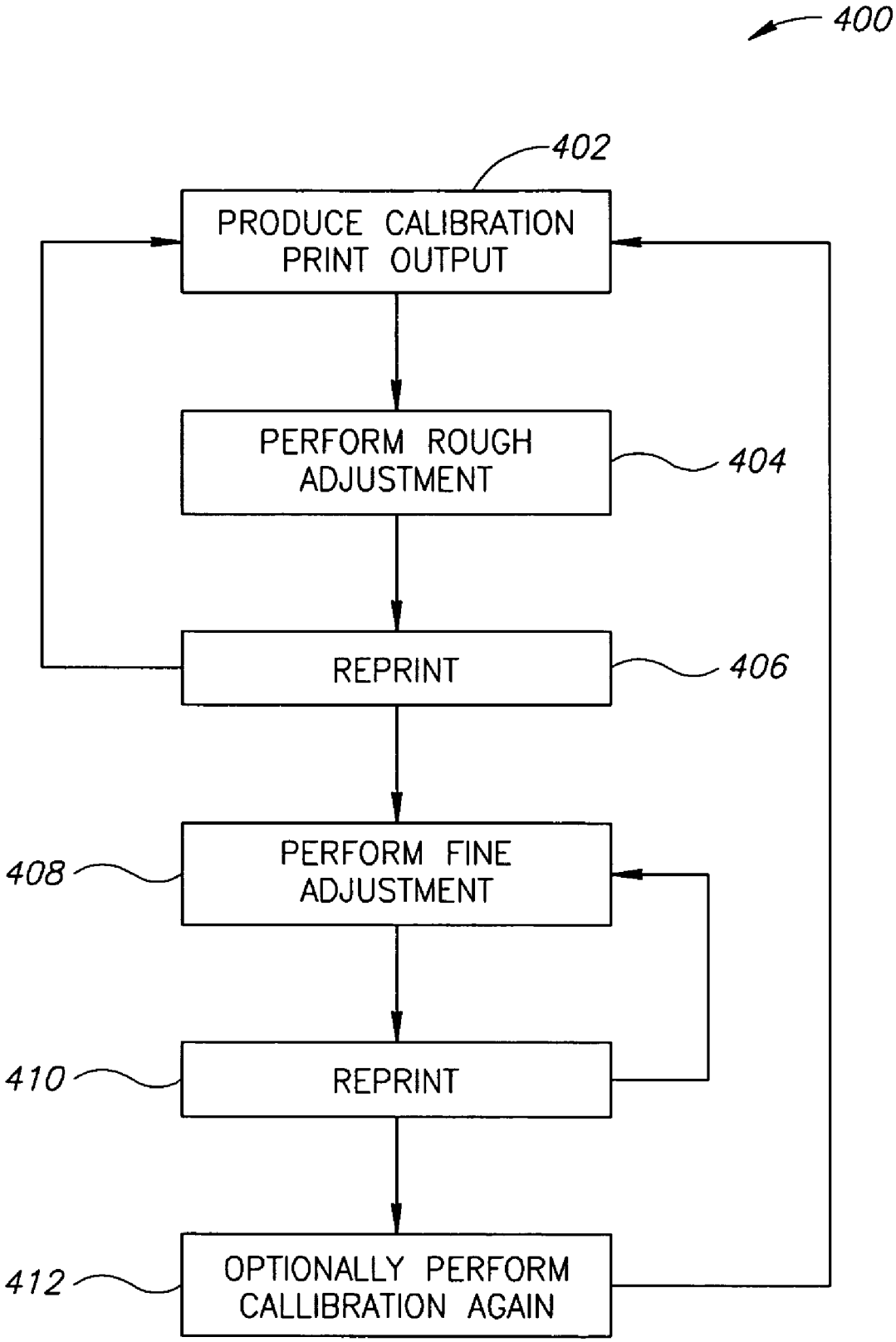

FIG. 4 is a flow chart 400 depicting a method of measuring and correcting misregistration between various separations, in accordance with an exemplary embodiment of the invention. It should be understood that that present methodology could be applied to any printing system or apparatus in which more than one separation is formed during printing. Calibration print output 200 is produced (402) by printing apparatus 100, in an embodiment of the invention. Typically, production (402) of calibration print output 200 occurs by first using scanning laser 106 to write sub-pattern 302 of a first of the separations used to comprise calibration print output to form a latent image on photoreceptor 102. This sub-pattern 302 image is developed in one of the colors by elements 108 and 110, as described above. The developed image is transferred to substrate 118. Next, a latent image corresponding to a second separation is written on photoreceptor 102. The latent image is then developed, preferably using a different color developer from that used to develop the first separation. This image is then transferred onto the image of the first separation on substrate 118. This results in the printed images shown in FIGS. 2-3. It should be understood that in some preferred embodiments of the invention, the images may be transferred directly to substrate 118 from photoreceptor 102, with ITM 114 omitted. Alternatively, both images may be transferred to ITM 114 before they are transferred together to substrate 118. In this case, the measurements may be made directly on the ITM. In some exemplary embodiments of the invention, more than two separations are used for forming calibration print output 200. For example, different calibration patterns are optionally used for registering different combinations of separations.

In an exemplary embodiment of the invention, the produced (402) calibration print output 200 is used to detect and correct misregistration between the separations. Optionally, a rough adjustment performed (404) on calibration print output 200 using rough adjustment lines 202, 204, or by any other means known in the art. In some embodiments of the invention, a first rough adjustment line 202 is printed in a different color than second rough adjustment line 204 so that they can be easily discerned from one another. In some embodiments of the invention, rough adjustment (404) is performed if the fine adjustment indicator, light band 306, is far removed from the "0" of corresponding offset markers 208 or is not present within calibration pattern 206 due to being "off the scale". Rough adjustment is optionally performed (404) if the rough adjustment lines 202, 204 do not touch or overlap each other on calibration print output 200, in an exemplary embodiment of the invention.

In some embodiments of the invention, a user of printing apparatus 100 manually inputs the misregistration data into controller 122 via user input device 126. In some embodiments of the invention, at least one sensor 124 automatically detects misregistration and communicates the misregistration data to controller 122. In a preferred embodiment of the invention, at least one sensor 124 is placed near the surface of calibration output 200 to measure the position of light band 306 and a corresponding offset marker 208 in a calibration pattern 206. Other sensors, as known in the art, may be used to measure the position of the markers 208, such that the controller can determine the relative offset of the band with respect to the markers.

In an exemplary embodiment of the invention, misregistration data includes an indication of whether first rough adjustment line 202 is to the left or right of second rough adjustment line using – or +. In addition, the instant methodology is intended to incrementally improve misregistration errors, and therefore the indication of left or right is also accompanied by a correction integer indicating how much left or right correction should be made by printing apparatus 100 in order to cause rough adjustment lines 202, 204 to touch or overlap. Optionally, the correction integer varies depending on the sensed or perceived misregistration error. Optionally, the correction integer is set depending on how precisely printing apparatus 100 can be controlled. Optionally, the correction integer is changed from one production (402) of calibration print output 200 to the next production (402), for example to make more fine adjustments.

In accordance with an exemplary methodology of the present invention, if first rough adjustment line 202 is to the left of second rough adjustment line 204, signaling that the first separation is horizontally misregistered to the left of the subsequent separation, controller 122 receives "–6" as misregistration data, where "–" indicates misregistration of the first separation to the left and the "6" indicating units, each unit comprised of 30 microns, of incremental correction to be implemented by printing apparatus 100 for the next printing. Optionally, each unit is comprised of more or fewer microns depending on the application or adjustment accuracy desired. In an exemplary embodiment of the invention, should first rough adjustment line 202 be to the right of second rough adjustment line 204, controller 122 would receive "+6" as misregistration data. In an embodiment of the invention, where the rough adjustment lines 202, 204 touch or overlap, no rough adjustment correction is to be made, thereby allowing for the input of "0" into controller 122 for rough adjustment misregistration data. In an embodiment of the invention, production (402) of calibration print outputs 200 and rough adjustment is performed (404) is repeated (406) until the incremental corrections of misregistration produce a calibration print output 200 wherein rough adjustment lines 202, 204 touch or overlap.

If a less sensitive version of the methodology of the fine adjustment is used for coarse adjustment, then this can be entered automatically, in the same way as described below.

In an exemplary embodiment of the invention, a fine adjustment is performed (408) after the optional rough adjustment (404). As described above, with respect to FIG. 3, calibration pattern 206 is analyzed to determine the approximate center of light band 306 with respect to corresponding offset markers 208. The value of the offset marker 208 which correlates to the approximate center of light band 306 is communicated to controller 122, in some embodiments of the invention. Optionally, the value assigned to the offset marker 208 which correlates to the approximate center of light band 306 is determined to within 0.5 unit or 15 micron accuracy. In some embodiments of the invention, center of light band 306 is associated with an offset marker which is within 0.5 of a unit from center of light band 306. Controller 122 assesses the misregistration fine adjustment data it receives in order to adjust printing apparatus 100 operation to compensate, at least partially, for the misregistration. In an exemplary embodiment of the invention, misregistration within a prescribed limit is considered properly registered. For example, if the approximate center of light band 306 is within 3.5 units of the "0", it is considered close enough to be properly registered in some embodiments of the invention.

In some exemplary embodiments of the invention, calibration print output 200 is provided with a plurality of calibration patterns located at various points on calibration print output 200. Calibration print output 200 depicted in FIG. 2 is shown with 8 calibration patterns, with 4 located near the left and right margins, respectively. In an exemplary embodiment of the invention, each of the plurality of calibration patterns is analyzed for the approximate center of the light band as it correlates to the offset markers corresponding to that calibration pattern and the misregistration data is communicated to controller 122. In some embodiments of the invention, at least one calibration pattern is printed on the reverse side of the substrate on which calibration print output 200 is printed. The reverse side is optionally analyzed in a manner similar to the front in order to correct misregistration in double sided printing applications. Upon the completion of communication of the misregistration data to controller 122, calibration print output 200 is optionally reprinted (410) to gauge the efficacy of the fine adjustments (408). Misregistration calibration is optionally performed (412) one or more times after completion of the fine adjustments (408) for adjustment verification and/or continued detection and correction of misregistration.

In some embodiments of the invention, the fine adjustment pattern is printed at several places across the image, or all across the image. This allows for the measurement of changes in horizontal registration across the page. While measurements taken at a border of the page are generally corrected by offsetting one separation from another, variations along the horizontal direction can be corrected by adjusting the instantaneous timing of the data along the horizontal sweep of the laser.

In the description and claims of the present application each of the verbs, "comprise" and "include" and conjugates thereof are used to convey that the object or objects of the verb are not necessarily a listing of all the components, elements or parts of the subject or subjects of the verb.

While the invention has been described with reference to certain preferred embodiments, various modifications will be readily apparent to and may be readily accomplished by persons skilled in the art without departing from the spirit and the scope of the above teachings. Various embodiments of the invention have been described having specific features. It should be understood that features of the various embodiments may be combined, where appropriate and features which are described above may be omitted, in some preferred embodiments of the invention. Therefore, it is understood that the invention may be practiced other than as specifically described herein without departing from the scope of the following claims:

The invention claimed is:

1. A method for detecting and correcting misregistration between a plurality of separations printed by a printing apparatus, comprising:

producing a calibration print output on a substrate, the calibration print output including at least one calibration pattern, wherein the at least one calibration pattern translates horizontal misregistration into a detectable indicator of misregistration in a process direction;

detecting misregistration; and, performing a fine adjustment of the horizontal position of at least one of the separations using the at least one calibration pattern.

2. A method according to claim 1, wherein a plurality of offset markers are associated with the at least one calibration pattern.

3. A method according to claim 2, wherein the fine adjustment is performed using the at least one calibration pattern and the associated offset markers.

4. A method according to claim 1, further comprising:

producing the calibration print output with a plurality of rough adjustment lines in addition to the at least one calibration pattern.

5. A method according to claim 4, further comprising:

correcting misregistration by performing a rough adjustment using the plurality of rough adjustment lines prior to performing the fine adjustment.

6. A method for detecting misregistration between a plurality of separations printed by a printing apparatus, comprising:

(a) producing a calibration print output on a substrate, the calibration print output including at least one calibration pattern with a plurality of corresponding offset markers, wherein the at least one calibration pattern translates horizontal misregistration into a detectable indicator of misregistration in a process direction.

7. A method according to claim 6, further comprising correcting misregistration by performing at least one of the following:

(b) a rough adjustment using a plurality of rough adjustment lines on the at least one calibration pattern; and, (c) a fine adjustment using the at least one calibration pattern and the corresponding offset markers.

8. A method according to claim 6, further comprising correcting misregistration by performing:

(b) a fine adjustment of the horizontal position of at least one of the separations using the at least one calibration pattern and the corresponding offset markers.

9. A method according to claim 1, wherein the at least one calibration pattern is produced from a plurality of sub-patterns.

10. A method according to claim 9, wherein each of the plurality of sub-patterns is associated with one of the plurality of separations.

11. A method according to claim 9, wherein at least one of the plurality of sub-patterns is produced in a different color than the rest of the plurality of sub-patterns.

12. A method according to claim 2, wherein performing a fine adjustment includes controlling operation of at least one laser of the printing apparatus to cause a light band in the at least one calibration pattern to be centered in relation to the associated offset markers.

13. A method according to claim 1, wherein the calibration print output is produced with a calibration pattern on the back of the substrate.

14. A method according to claim 4, wherein each of the plurality of rough adjustment lines is associated with one of the plurality of separations.

15. A method according to claim 4, wherein at least one of the plurality of rough adjustment lines is produced in a different color than the rest of the plurality of rough adjustment lines.

16. A method according to claim 5, wherein performing a rough adjustment includes controlling operation of the printing apparatus to cause the plurality of rough adjustment lines to at least touch.

17. A printing apparatus for detection and correction of horizontal misregistration between a plurality of print separations, comprising:

a latent image forming device adapted for forming a plurality of latent images of said plurality of print separations, developing the latent image, and printing the latent image on a substrate;

a controller in communication with at least said latent image forming device adapted to control said latent image forming device in the forming of a calibration pattern, which translates horizontal misregistration into a detectable indicator of misregistration in a process direction, sufficient for detection and correction of horizontal misregistration between said plurality of print separations on a calibration print output; and, wherein upon receipt by said controller of an indication of horizontal misregistration, said controller controls the latent image forming device to form the plurality of latent images in at least an incremental step towards correcting the horizontal misregistration.

18. A printing apparatus according to claim 17, further comprising a user input device including a display which prompts a user to input detected horizontal misregistration in communication with said controller.

19. A printing apparatus according to claim 17, further comprising at least one sensor adapted to sense at least one indicator of horizontal misregistration on said calibration print output and communicate the sensed misregistration to said controller.

20. A printing apparatus according to claim 19, wherein the at least one indicator of horizontal misregistration is the calibration pattern comprised of at least two sub-patterns which when overlapped form a light band within the calibration pattern.

21. A printing apparatus according to claim 20, wherein said calibration pattern includes a plurality of corresponding offset markers.

22. A printing apparatus according to claim 19, wherein the at least one sensor is positioned to sense a calibration pattern printed on the back of the substrate.

23. A printing apparatus according to claim 20 wherein the at least one sensor is positioned to view more than one calibration pattern printed on the calibration print output.

24. A printing apparatus according to claim 17, wherein at least one of said plurality of separations is printed in a different color than the rest of the separations.

25. A printing apparatus according to claim 17, wherein at least one of said plurality of separations is printed in the same color as another of the separations.

* * * * *